US005192304A

United States Patent [19]

Rassman

[11] Patent Number: 5,192,304

[45] Date of Patent: Mar. 9, 1993

[54] APPARATUS FOR MANIPULATING BACK MUSCLES

[76] Inventor: William R. Rassman, 29391 Laro Dr., Agoura, Calif. 91301

[21] Appl. No.: 716,137

[22] Filed: Jun. 17, 1991

[51] Int. Cl.[5] ..... A61H 9/00; A47C 27/10

[52] U.S. Cl. ..... 606/238; 606/239; 128/33; 5/933

[58] Field of Search ..... 128/33, 51-55; 606/238, 239, 242; 5/933, 934

[56] References Cited

U.S. PATENT DOCUMENTS

| | | | |
|---|---|---|---|
| 3,207,152 | 9/1965 | Thornton | 128/33 |
| 3,656,190 | 4/1972 | Regan et al. | 128/33 X |
| 3,867,732 | 2/1975 | Morrell | 5/453 |
| 3,919,730 | 11/1975 | Regan | 128/33 X |
| 4,085,738 | 4/1978 | Kodera | 128/52 X |
| 4,175,549 | 11/1979 | Hamer | 606/242 X |
| 4,525,885 | 7/1985 | Hunt et al. | 5/453 |
| 4,697,290 | 10/1987 | Alklind et al. | 5/455 X |
| 4,779,615 | 10/1988 | Frazier | 128/54 X |
| 4,799,276 | 1/1989 | Kadish | 5/933 X |

FOREIGN PATENT DOCUMENTS

| | | | |
|---|---|---|---|
| 1304736 | 8/1962 | France | 128/33 |
| 204194 | 10/1985 | Japan | 128/33 |
| 8808290 | 11/1988 | PCT Int'l Appl. | 128/33 |

*Primary Examiner*—Randall L. Green
*Assistant Examiner*—Mary Beth O. Jones
*Attorney, Agent, or Firm*—Herbert M. Shapiro

[57] ABSTRACT

Apparatus for the manipulation of the bones, joints and muscle groups of the human back and neck for achieving mobility comprises a bed of solenoids on which the patient lies. The patient is positioned on the bed with respect to locator arms which ensure that the solenoids are activated to generate a cyclical pattern of forces in proper positions with respect to fixed skeletal positions. Mobility is quickly returned to the patient who lies passively on the bed during treatment.

9 Claims, 2 Drawing Sheets

APPARATUS FOR MANIPULATING BACK MUSCLES

FIELD OF THE INVENTION

This invention relates to apparatus for relieving back pain and more particularly to apparatus for manipulating the back skeleton in a manner to promote mobility in the muscles, bones and joints of the human back.

BACKGROUND OF THE INVENTION

Back problems are endemic in the human species. Seemingly, since humans started to stand erect, we have been plagued by back problems.

Over the last few decades, a variety of back manipulating devices have become available. Some of these provide a bed for a patient. The bed includes a array of cylindrical pockets, the vertical dimension of which can be increased or decreased pneumatically, hydraulically, or mechanically. The apparatus usually also includes a control arrangement to impart a tidal motion to the array to cause a rythmic manipulation of the back muscles to restore mobility. Unfortunately, such devices produce relatively little benefit, and in cases where significant muscle spasm exists, may be counter productive.

Most individuals experience back pain at one time or another. Such pain is acute and disabling. In most instances, bed rest and time reduce pain sufficiently for activities to be resumed.

The manipulation of the human back is the domain of the health care specialist. In some instances, a chiropractor can help reduce the amount of time required before activities can be resumed. At times, medications are needed to treat either the pain or the muscle spasms associated with back problems. In extreme cases, surgery is necessary.

In most instances, back pain is initiated by some trauma which results in the misalignment of some back bone or bones, joints or muscles which, in turn, induces muscle spasms. The various muscle groups respond unfortunately by overcompensating tension adjustments which may compound the problem by producing greater pain and more misalignment. Bed rest or chiropractic manipulation or physical therapy provides the means for realigning of the bones and eliminating the muscle spasms. The time required for relief usually depends on the manner in which the back muscle groups are manipulated. The present invention is directed at apparatus for manipulating the skeletal frame and, thus, the muscle groups of the human back while the patient is inactive.

BRIEF DESCRIPTION OF ILLUSTRATIVE EMBODIMENTS OF THE INVENTION

In accordance with the principles of this invention, apparatus comprising an array of pockets (such as air-filled plastic cylinders), is employed as a bed for a patient. Further, a control is provided for increasing and decreasing the vertical dimension of the individual pockets to manipulate a patient for restoring mobility. But the apparatus also includes indicia means for locating certain reference points in a patient's skeletal frame with respect to the pocket array for establishing an initial equal force contour pattern for the array surface. The apparatus may also include a computer, or control device, for controlling the consecutive patterns of the array surface with respect to the initial contour. Because of the association of certain locations in the array with fixed skeletal positions, the periodic pattern imparted to the array surface under computer control can be made to emulate a swimming motion which causes joint and muscular motion in a natural way not possible without first ascertaining the skeletal reference positions.

Further, therapeutic motion can be provided under computer control by providing software templates for individual therapy. Such therapy is provided for example under the care of a health care specialist in response to an acute back problem where a patient is in severe pain and cannot even lie flat on the bed. The locator apparatus is manipulated to determine the position of the skeletal reference positions of the patient and the vertical displacement of those positions from the plane of the bed. The present invention is directed at apparatus for manipulating the skeletal frame of the human back while the patient is inactive. Such cases provides vertical distance measurements where, for example, a shoulder or a hip is elevated from the plane of the bed surface due to pain.

Another instance in which a therapeutic template may be used is the case where an asymmetry in the shoulder reference points or the hip reference points is greater than a threshold amount indicating a spinal curvature. A template modifying the repetitive recontouring of the surface to take such curvature into account may be in order.

For air filled cylinders, a pump and tube arrangment connects the underside of the cylinders to inflate and deflate the air cylinders according to a cyclical pattern controlled by a computer and set by the locator arms. The movement of the cylinders manipulate the bones and joints and, thus, the muscle groups in the back to reduce spasms and to permit realignment of the bones in the back. It is the ineffective activity of the muscle groups to realign some misaligned back bones which result in the muscle spasms and thus the back pain.

DETAILED DESCRIPTION OF AN ILLUSTRATIVE EMBODIMENT OF THIS INVENTION

Figure 1:
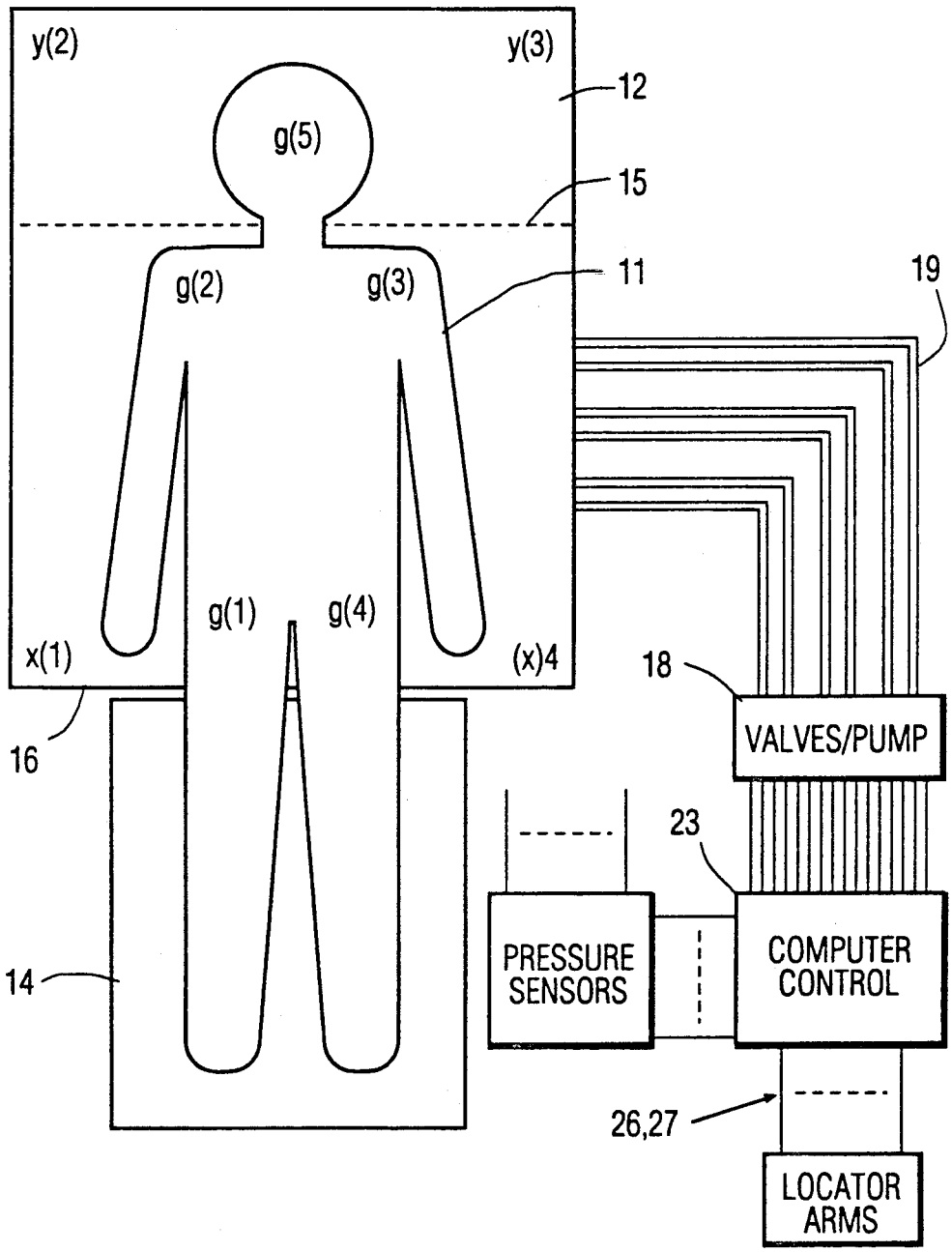
FIG. 1 is a schematic top view of a therapeutic bed in accordance with the principles of this invention showing a stylized representation of a patient on the bed.
Figure 3:
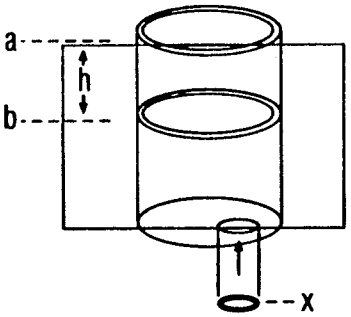
FIGS. 3 and 4 are schematic views of a cylinder of FIG. 2 in operation of the bed of FIG. 1.
Figure 4:
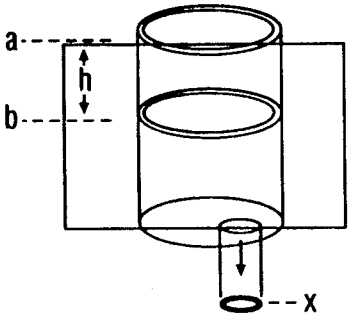

FIG. 1 shows a patient 11 lying flat on bed 12. Bed 12 is shown as extending beneath the torso of the patient with extension 14 supporting the legs of the patient. An array of cylinders comprise the area of the bed under the patients torso from the neck area as indicated by broken line 15 to the area at the top of the legs as indicated by line 16.

Figure 2:
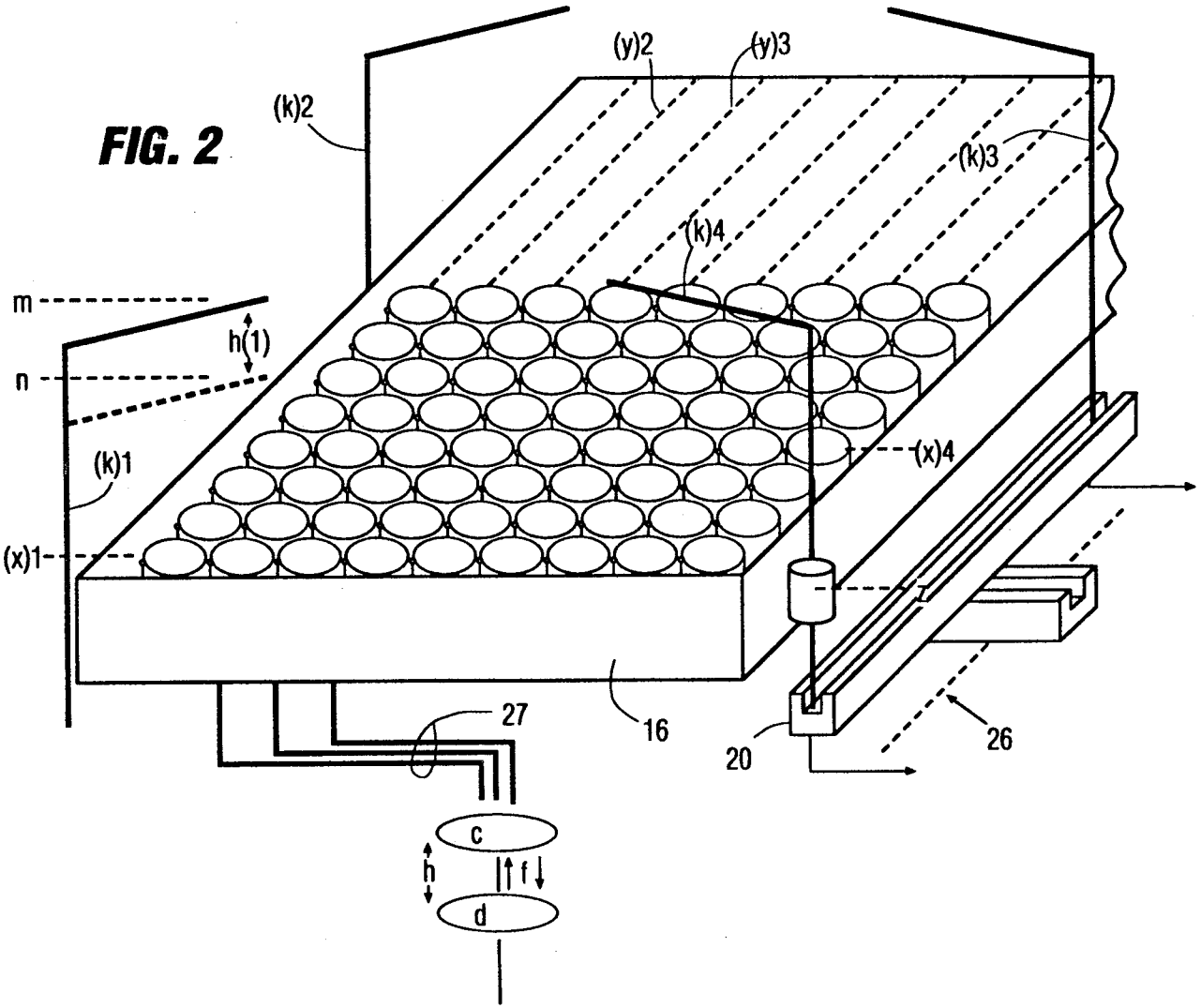
FIG. 2 is a schematic representation of a portion of the bed of FIG. 1 showing an array of cylinders controllable for contouring the surface thereof for applying pressure to the back of a patient.

The cylinders are shown in FIG. 2 as being circular in cross section but may have a square, rectangular, triangular or any other convenient shape. Moreover, the cylinders may be solenoids respectively moved magnetically, or may be air or liquid filled to be respectively controlled hydraulically or pneumatically by pneumatic pump means 18 including pneumatic tubing 19. U.S. Pat. No. 3,919,730 issued Nov. 18, 1975; U.S. Pat. No. 3,867,732, issued Feb. 25, 1975; U.S. Pat. No. 4,697,290 issued Oct. 6, 1987; and U.S. Pat. No. 4,525,885 issued Jul. 2, 1985 are representative of the large number of suitable patient manipulating beds which may be employed in accordance with the principles of the present invention.

All of these reference patents respond to the body weight of a patient and thus deal in terms of relative weight where each cylinder may be adjusted to compensate for the body weight at the position of the cylinder. The result is not an "equal force" contour. None of the references obtains the skeletal reference points of a patient and thus none is capable of imparting periodic motion to the patient in a manner to duplicate a swimming regimen. Only by the use of locator apparatus can an "equal force" profile be provided with respect to the skeletal reference points of a patient for providing a tailored motion which properly manipulates the skeletal frame and, thus, the muscles and joints in a manner mimicing the natural action of swimming.

The skeletal reference points are obtained illustratively by arms K1, K2, K3, and K4 which are movable along tracks aligned along the y axis of the bed. A representative track 20 is shown for locator arms K3 and K4. Movement of the arms to the shoulders, the pelvis (superior Iliac spines), and the sternum provide five reference points for the patient. Electrical connections completed by the locator arms in the selected positions for the left shoulder and left superior Iliac spine of a patient lying on his back are transmitted to computer control 23 of FIG. 1, via conductors 26 and 27. The computer relates the arm positions to the X row of the array. The Y positions for the reference skeletal positions are ascertained simultaneously or subsequently by movement of track 20 along track 24. The location of the sternum may be ascertained separately by an additional locator arm (not shown) or by the use of one of the arms K1 through K4 under operator control. Operator control is provided via a keyboard (not shown) considered part of control 23 of FIG. 1.

The computer in response to inputs from the locator arm apparatus obtains a template which constitutes the initiating "equal force" contour of the array surface with respect to the skeletal fiduciary positions. The computer then imparts to each cylinder in the array a periodic vertical displacement which varies about the vertical position determined by the locator arms for the initial array surface contour. The patient thus is subjected to a force applied to bones, joints, and muscles which produces a motion with a natural rythm which mimics swimming in the action on the patient's joints and muscles. Mobility is quickly restored.

What is claimed is:

1. Back manipulating apparatus comprising a bed for a patient, said bed comprising a frame and an array of pockets mounted on the frame each having a first vertical dimension, said apparatus including control means for selectively varying the vertical dimensions of individual ones of said pockets, said apparatus also including locator means attached to said frame and spaced from said array for locating skeletal reference points of a patient with respect to said bed and for generating signals representative of the locations of said positions, said control means being responsive to said signals for defining an initial equal force contour for said array and for manipulating said vertical dimensions of said pockets in a manner to provide a periodic succession of force contours starting with said initial equal force contour.

2. Apparatus as set forth in claim 1 wherein said locator means includes a plurality of locator arms, each of said arms being adjustable in the plane of said and in a direction normal to the plane of said bed.

3. Apparatus as set forth in claim 2 wherein said locator arms, comprises four locator arms respectively associated with the right and left shoulders and the right and left hip of a patient.

4. Apparatus as set forth in claim 3 also including means for locating the position of the sternum of said patient with respect to the positions of said four locator arms.

5. Apparatus for manipulating the bones, joints and muscle groups of the human back, said apparatus comprising a frame a planar array of pockets mounted on said frame on which a patient may be placed, each of said pockets having a cross sectional area which is small with respect to the surface area of the back;

locator means attached to said frame and spaced from said array for determining fixed skeletal reference positions of said patient and control means connected to said locator means for obtaining an initial equal force contour for said array of pockets with respect to said reference positions wherein said control means repetitively alter the vertical dimensions of individual ones of said pockets from respective positions defined by said initial equal force contour to impart a cyclical pattern of forces to said back of said patient.

6. Apparatus as set forth in claim 5 wherein said control means for altering the vertical dimensions of said pockets comprises a computer which is responsive to the setting of said locator arms.

7. Apparatus as set forth in claim 6 also including a pump and pneumatic tubing means for controlling a supply of air to individual ones of said pockets, each of said pockets comprising a sealed expandable cylinder for receiving air.

8. Apparatus as set forth in claim 7 wherein said pump inflates and deflates said sealed cylinders individually or in sets controllably.

9. Apparatus as set forth in claim 6 wherein said control means is operative to change the vertical positions of said pockets individually or in sets.

* * * * *